US007004732B2

(12) United States Patent
Cho et al.

(10) Patent No.: US 7,004,732 B2
(45) Date of Patent: Feb. 28, 2006

(54) FAN SHROUD ASSEMBLY

(75) Inventors: Kyungseok Cho, Daejeon-si (KR); Seyoung Park, Daejeon-si (KR); Changho Park, Daejeon-si (KR)

(73) Assignee: Halla Climate Control Corporation, Daejeon-si (KR)

( * ) Notice: Subject to any disclaimer, the term of this patent is extended or adjusted under 35 U.S.C. 154(b) by 344 days.

(21) Appl. No.: 10/619,713

(22) Filed: Jul. 14, 2003

(65) Prior Publication Data

US 2004/0009062 A1 Jan. 15, 2004

(51) Int. Cl.
*F04B 35/04* (2006.01)

(52) U.S. Cl. ..... 417/423.15; 165/51; 165/121; 165/122

(58) Field of Classification Search ..... 417/423.15, 417/423.14; 123/41.65, 41.66, 41.49; 165/51, 165/121, 122
See application file for complete search history.

(56) References Cited

U.S. PATENT DOCUMENTS 4,213,426 A * 7/1980 Longhouse ..... 123/41.49
6,027,307 A * 2/2000 Cho et al. ..... 415/173.5
6,209,627 B1 * 4/2001 Hasumi ..... 165/122
6,755,157 B1 * 6/2004 Stevens et al. ..... 123/41.49
6,802,699 B1 * 10/2004 Mikami et al. ..... 417/369

* cited by examiner

*Primary Examiner*—Timothy S. Thorpe
*Assistant Examiner*—Vikansha Dwivedi
(74) *Attorney, Agent, or Firm*—Bachman & LaPointe, P.C.

(57) ABSTRACT

The fan shroud assembly includes: a rectangular-shaped plenum having a first plenum portion of a larger side and a second plenum portion of a smaller side, which are mounted eccentrically; a fan shroud formed on an air discharge side of the plenum and having a airflow guide portion, in which a fan having a blade and a band for connecting the outer end of the blade, is positioned; and a motor for driving the fan, wherein a connection point between the first plenum portion and the airflow guide portion is located within a height (BH) of the band, and wherein a height (H1) from the bottom of the plenum to connection point between the first plenum portion and the airflow guide portion is higher than a height (H2) from the bottom of the plenum to connection point between the second plenum portion and the airflow guide portion satisfying H1>H2.

5 Claims, 6 Drawing Sheets

$(H_1 > H_2,\ h_1 > h_2,\ H_1 = h_1,\ H_2 > h_2,\ H_2 < h_1,\ H_1 > h_2)$

Prior Art

Prior Art

Prior Art

Prior Art ($H_1 > H_2$, $h_1 > h_2$, $H_1 = h_1$, $H_2 > h_2$, $H_2 < h_1$, $H_1 > h_2$)

($H_1 > H_2$, $h_1 = h_2$, $H_1 > h_1$, $H_2 > h_2$, $H_2 > h_1$, $H_1 > h_2$)

FAN SHROUD ASSEMBLY

BACKGROUND OF THE INVENTION

1. Field of the Invention

The present invention relates to a fan shroud assembly.

2. Background of the Related Art

In general, an engine room of a vehicle includes an engine which is a vehicle driving device, a cooling device for preventing overheating of the engine, and an air conditioning device for purifying air of a passenger side inside the vehicle.

A cooling method of the engine of the vehicle is divided into an air-cooling type and a water-cooling type. The water-cooling type engine cooling method is to cool the engine using coolant, which flows along the outer surface of the engine.

The water-cooling type engine cooling device includes a radiator attached to the front of the engine of the vehicle for cooling the coolant of the engine, and a fan assembly attached to the radiator for enhancing heat exchanging efficiency.

The fan shroud assembly generally includes a fan, a driving motor for rotating the fan, and a fan shroud for supporting the fan.

FIG. 1 is a perspective view of a conventional fan shroud assembly equipped with a fan eccentrically mounted, and FIG. 2 is a sectional view taken along the line of I—I of FIG. 1.

As shown in the drawings, the fan shroud assembly 10 includes: a plenum 11 having a first plenum portion 11*a* of a larger side and a second plenum portion 11*b* of a smaller side, the first and second plenum portions 11*a* and 11*b* being eccentrically mounted corresponding to the front of the radiator by a support structure(not shown); a airflow guide portion 15 formed on an air discharge side of the plenum 11, a fan 14, which has a blade 12 and a band 13 for connecting the outer end of the blade 12, a motor mounting 16 located at the center of the airflow guide portion 15 for mounting of a motor 18; and a stator 17 for connecting the motor mounting 16 and the airflow guide portion 15.

Here, the airflow guide portion 15 is located at a portion where the first plenum portion 11*a* and the second plenum portion 11*b* are located at eccentric positions to each other.

As described above, the fan 14 receiving driving power of the motor 18 is rotated, the air passing the radiator is inhaled and guided by the plenum 11, and then, discharged to an engine side(not shown) through the stator 17 of the airflow guide portion 15.

However, according to the prior arts, as the fan 14 is not located at the center of the plenum 11 but biased to one side, in a state in which a connection point P1 between the first plenum portion 11*a* and the airflow guide portion 15 is equal to the lowermost end of a height BH of the band 13, the first plenum portion 11*a* is formed straight downwardly, and a height H1 from the bottom B of the plenum 11 to the connection point P1 between the first plenum portion 11*a* and the airflow guide portion 15 is equal to a height H2 from the bottom B of the plenum 11 to a connection point P1' between the second plenum portion 11*b* and the airflow guide portion 15.

Because the height H1 from the bottom B of the plenum 11 to the connection point P1 between the first plenum portion 11*a* and the airflow guide portion 15 is lower than or equal to the height H0 from the bottom B to the lowermost end of the band 13, the air flow area is reduced, and thereby, the prior art has several problems that airflow is reduced and noise is generated.

U.S. Pat. No. 5,024,267 will be described hereinafter with reference to FIG. 3. U.S. Pat. No. 5,024,267 discloses a cooling apparatus which does not have any band.

As shown in the drawing, a cylindrical portion 21 of a shroud 20 of the cooling apparatus, in which a fan is disposed, is biased to one side as shown in FIGS. 1 and 2.

The shroud 20 has a first plenum portion 22 of a larger side and a second plenum portion 23 of a smaller side as the cylindrical portion 21 is biased to one side.

Here, the height H1 from the lowermost end of the cylindrical portion 21 to the first plenum portion 22 is equal to the height H2 from the lowermost end of the cylindrical portion 21 to the second plenum portion 23.

That is, as in the prior arts of FIGS. 1 and 2, the height H1 from the bottom B of the plenum 11 to the connection point P1 between the first plenum portion 11*a* and the airflow guide portion 15 is equal to the height H2 from the bottom B to the connection point P1' between the second plenum 11*b* and the airflow guide portion 15. Furthermore, also the above prior art has the above problems that the airflow is reduced and noise is generated, as the prior art does not have the band 13 shown in FIGS. 1 and 2.

As another example of the prior arts, U.S. Pat. No. 6,099,247 will be described. Referring to FIGS. 4 and 5, a fan shroud for internal combustion engine according to U.S. Pat. No. 6,099,247 includes an intake manifold 31 attached to one side (in a right direction) of an internal combustion engine 30, and an exhaust manifold 32 attached to the other side (in a left direction) of the internal combustion engine 30, which is an exhaust system part.

A cooling device 33 is mounted in front of the internal combustion engine 30.

The cooling device 33 has a cooling fan 34 attached by a fan shaft 35 to internal combustion engine 30, and a radiator 36 is installed, opposite to the cooling fan 34.

Attached to the radiator 36 is a fan shroud 38, equipped with an airflow guide portion 37 which encircles the cooling fan 34 and is formed as a circle.

Here, the cooling fan 34 is located inside the airflow guide portion 37. To increase cooling air, a clearance C1 between the airflow guide portion 37 and the cooling fan 34, which belongs to a first plenum portion 38*a* of a larger side of the fan shroud 38, is larger than a clearance C2 between the airflow guide portion 37 and the cooling fan 34, which belongs to a second plenum portion 38*b* of a smaller side of the fan shroud 38. However, also, U.S. Pat. No. 6,099,247 still has the above problems that the airflow is reduced and noise is generated.

As the cooling fan 34 is rotatably mounted on the fan shaft 35 rotating by directly receiving driving power of the internal combustion engine 30, the cooling fan 34 is vibrated together with the driving internal combustion engine 30. Thereby, the air does not flow uniformly but flows irregularly, and so, the cooling efficiency is reduced.

U.S. Pat. No. 4,213,426, which is another example of the prior arts, will be described hereinafter with reference to FIG. 6.

As shown in the drawing, a shaft 43 rotated by receiving driving power of an engine 42 is attached to a vehicle frame 40 in front of an end of the engine 42 mounted by the medium of a brocket 41.

A hub 44 is fixed to an end of the shaft 43, a number of blades 45 are disposed on the hub 44, and a fan shroud 46 that is integral with the outer tips of the blades 45.

The hub 44, the blades 45 and the fan shroud 46 are vibrated together with the driving engine 42 as they are rotated by receiving driving power of the engine 42. To inhale the vibration, an outer shroud assembly 51 connected with a radiator 50 is attached to the outside of the fan shroud 46, the outer shroud assembly 51 is moved flexibly.

However, the fan shroud assembly according to the prior art cannot flow the air in a uniform direction but flows the air in an irregular direction due to the vibration in spite of the outer shroud assembly 51. Moreover, the fan shroud assembly has a problem in that the air flow is reduced and noise is generated.

SUMMARY OF THE INVENTION

Accordingly, the present invention has been made in view of the above problems, and it is an object of the present invention is to provide a fan shroud assembly which can change the height of the plenum portion, which is a wider portion, when the fan is located not at the center of the plenum but at the eccentric position to secure a larger plenum area so as to increase airflow, and improve its performance, i.e., reduction of power consumption and noise.

To achieve the above object, according to the present invention, there is provided a fan shroud assembly includes: a rectangular-shaped plenum having a first plenum portion of a larger side and a second plenum portion of a smaller side, which are mounted eccentrically; a fan shroud formed on an air discharge side of the plenum, the fan shroud having a airflow guide portion, in which a fan having a blade and a band for connecting the outer end of the blade, is mounted; and a motor for driving the fan, wherein a connection point between the first plenum portion and the airflow guide portion is located within a height (BH) of the band, and wherein a height (H1) from the bottom of the plenum to connection point between the first plenum portion and the airflow guide portion is higher than a height (H2) from the bottom of the plenum to connection point between the second plenum portion and the airflow guide portion to satisfy the following Expression: H1>H2.

DETAILED DESCRIPTION OF THE PREFERRED EMBODIMENT

Reference will now be made in detail to the preferred embodiments of the present invention, examples of which are illustrated in the accompanying drawings.

Figure 1:
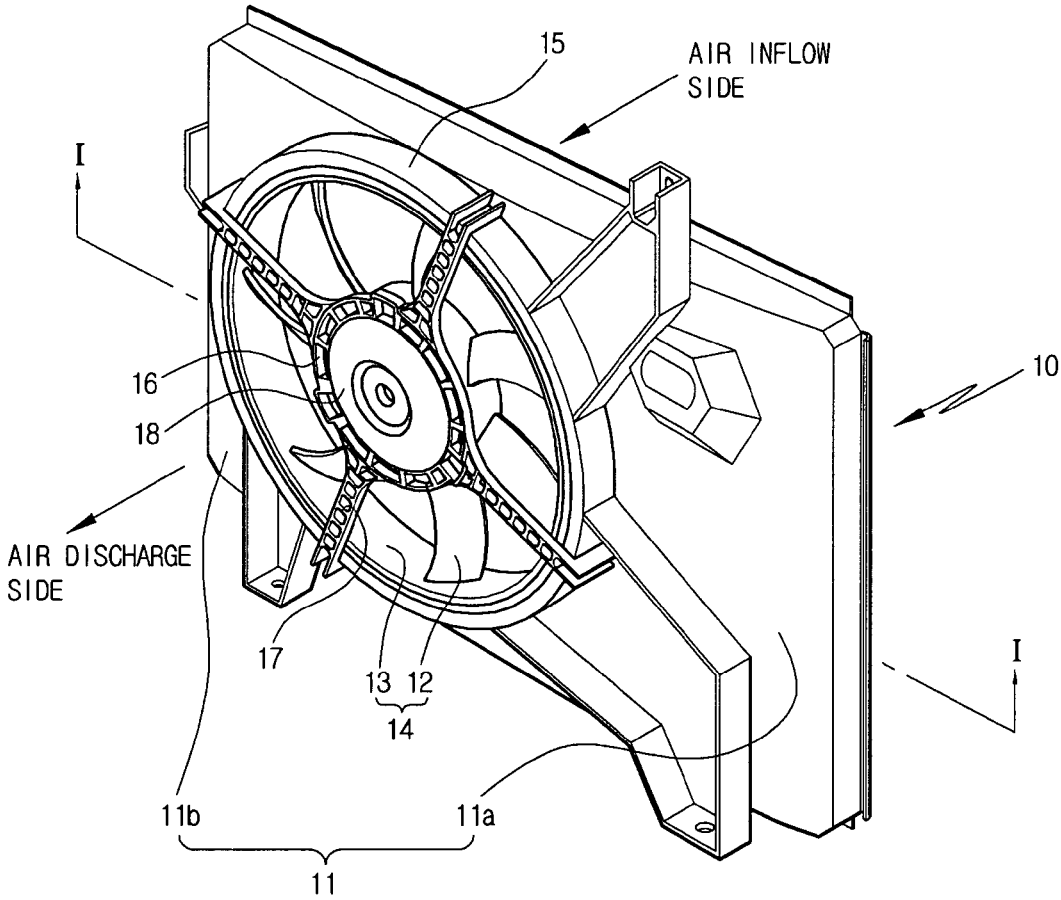
FIG. 1 is a perspective view of a conventional fan shroud equipped with a fan mounted eccentrically.
Figure 2:
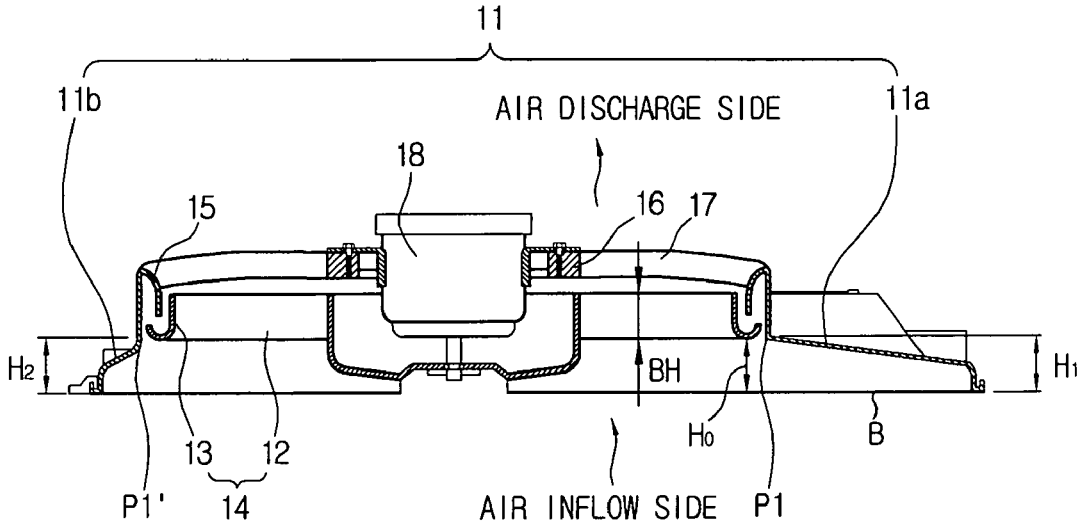
FIG. 2 is a sectional view taken along the line of "I—I" of FIG. 1.
Figure 3:
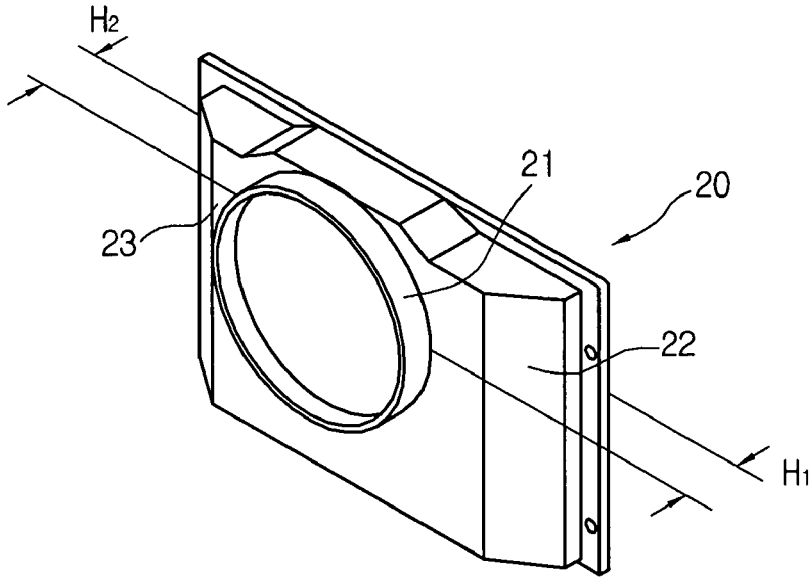
Prior Art Figure 3
FIG. 3 is a perspective view of a shroud of a cooling device according to the prior arts.
Figure 4:
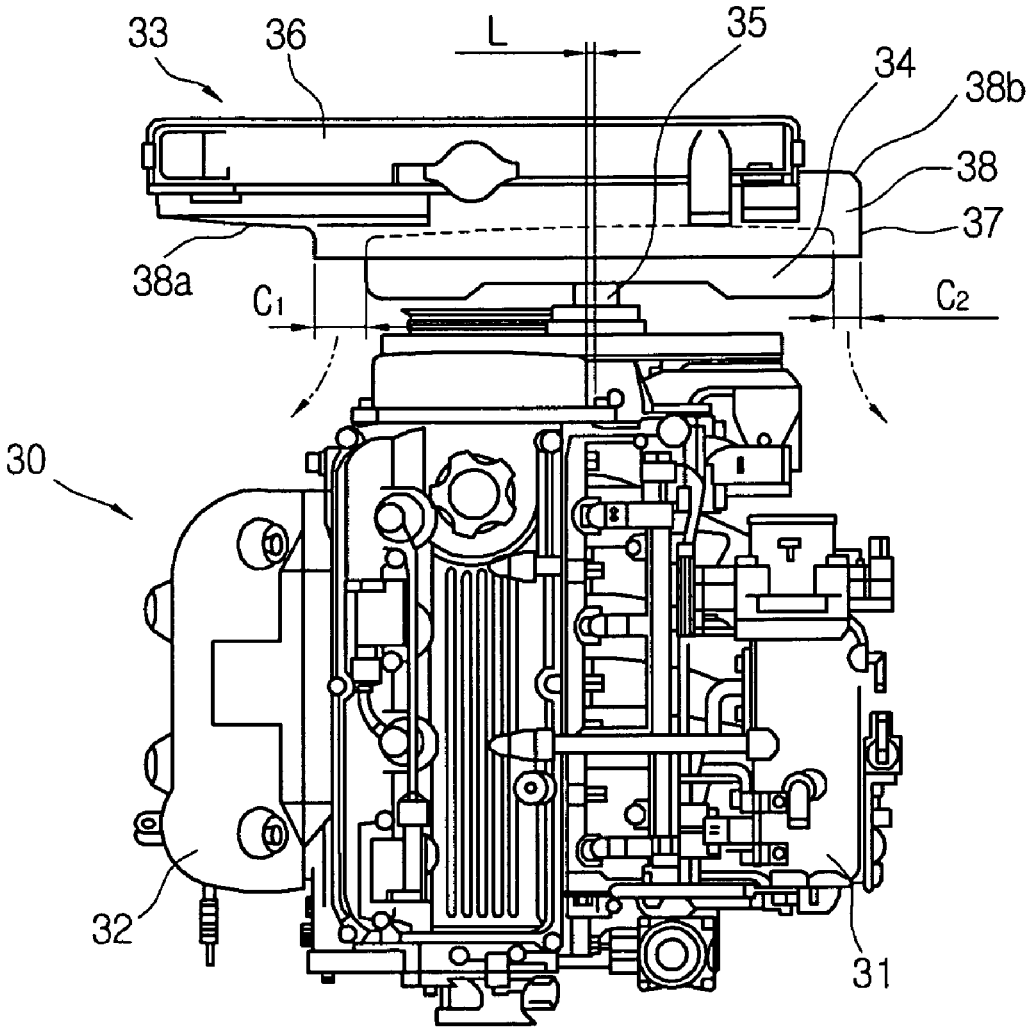
FIG. 4 is a plan view of an internal combustion engine according to the prior arts.
Figure 5:
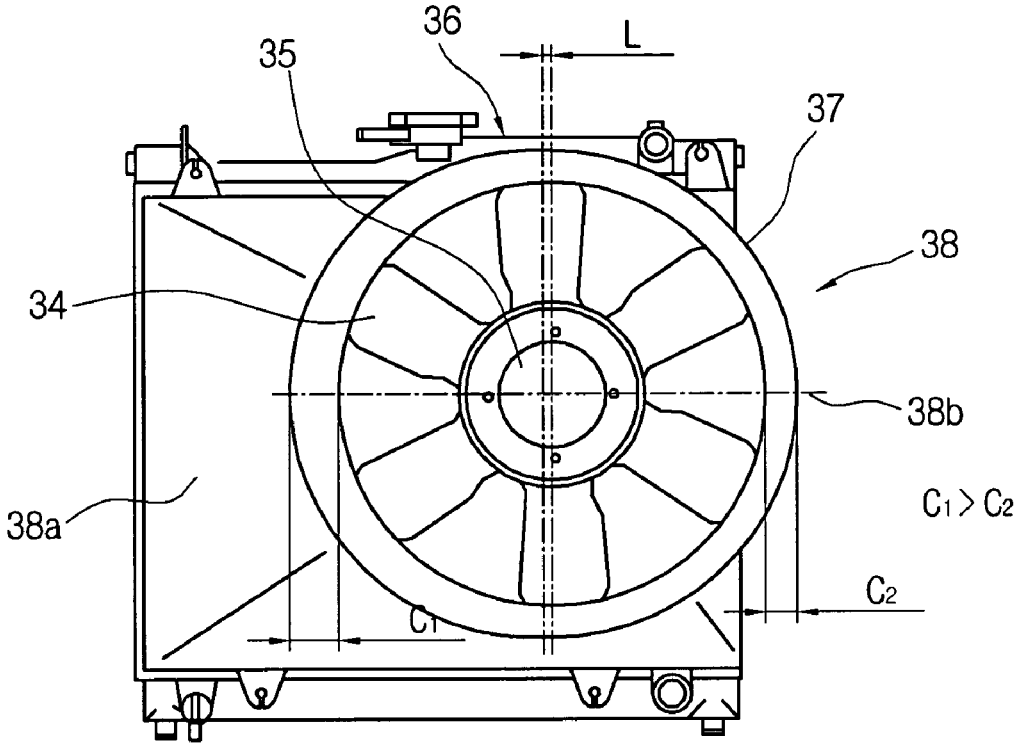
FIG. 5 is a rear view of a radiator of FIG. 4.
Figure 6:
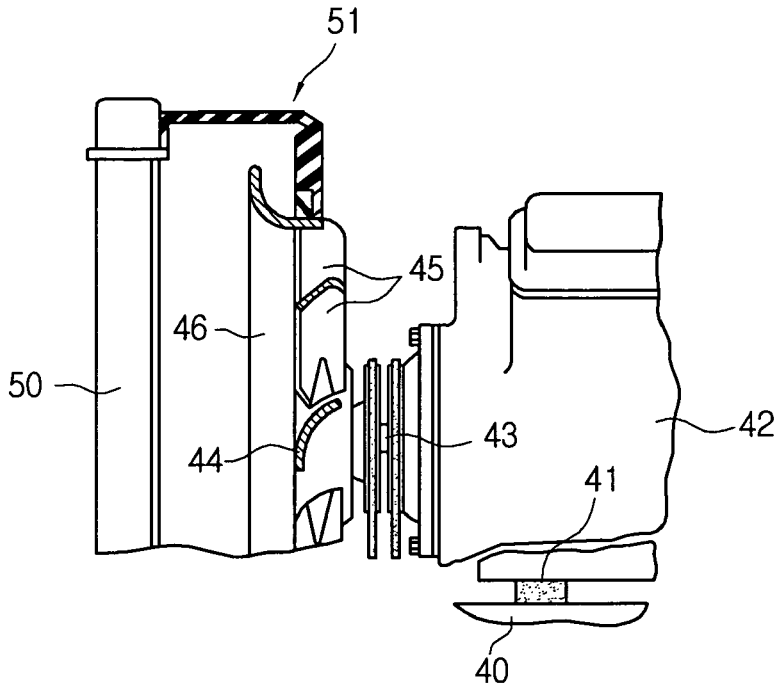
FIG. 6 is a partially sectional view of another cooling device according to the prior arts.
Figure 7:
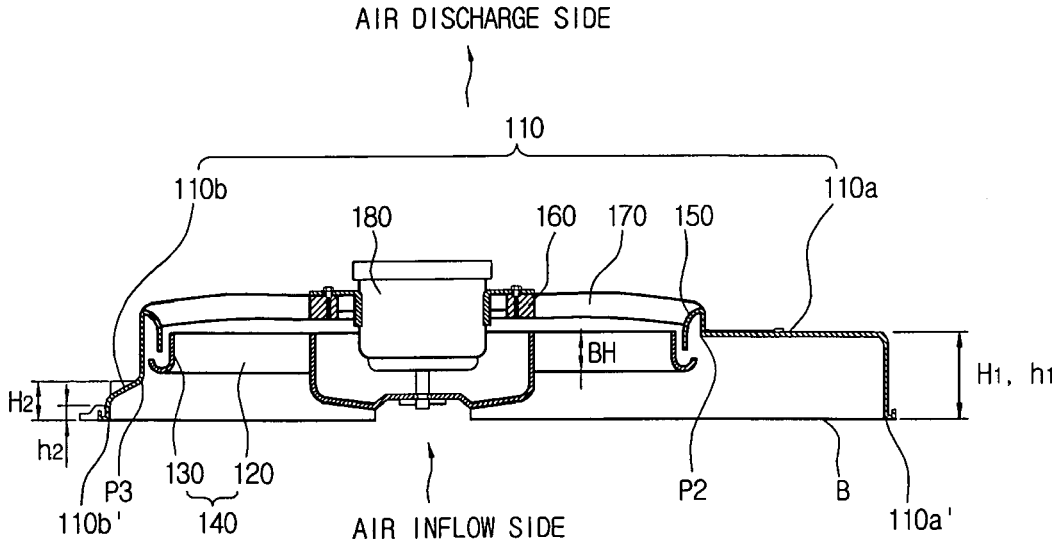
Prior Art Figure 7
FIG. 7 is a sectional view of a fan shroud assembly according to a first preferred embodiment of the present invention.
Figure 8:
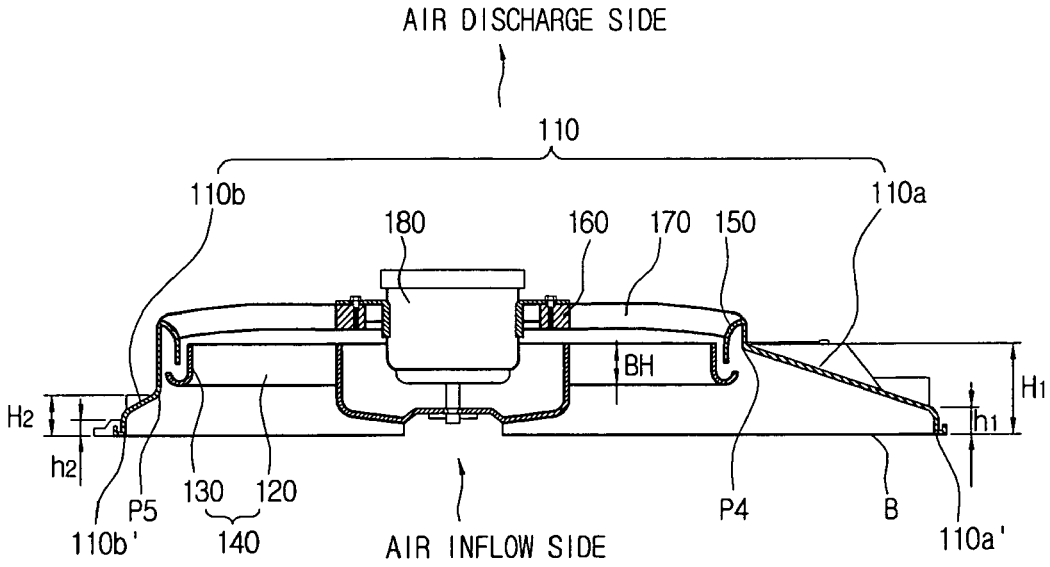
FIG. 8 is a sectional view of a fan shroud assembly according to a second preferred embodiment of the present invention.

FIG. 7 is a sectional view of a fan shroud assembly according to a first preferred embodiment of the present invention, and FIG. 8 is a sectional view of a fan shroud assembly according to a second preferred embodiment of the present invention.

As shown in the drawings, the fan shroud assembly according to the present invention includes a fan shroud and a motor 180.

The fan shroud assembly according to the present invention includes: a rectangular-shaped plenum 110 having a first plenum portion 110*a* of a larger side and a second plenum portion 110*b* of a smaller side, the first and second plenum portions 11*a* and 11*b* being mounted eccentrically corresponding to the front of the radiator; the fan shroud formed on an air discharge side of the plenum 110, the fan shroud having a airflow guide portion 150 in which a fan 140 having a blade 120 and a band 130 for connecting the outer end of the blade 120 is positioned; and the motor 180 for driving the fan 140.

The motor 180 is located at the center of the airflow guide portion 150 and attached to a motor mounting 160, and the motor mounting 160 is connected to the airflow guide portion 150 by the medium of a stator 170.

A connection point P2 between the first plenum portion 110*a* and the airflow guide portion 150 is located within a height BH of the band 130 of the fan 140.

As described above, that the connection point P2 between the first plenum portion 110*a* and the airflow guide portion 150 is within the height BH of the band 130 means that the connection point P2 between the first plenum portion 110*a* and the airflow guide portion 150 is formed upwardly on the basis of the band 130.

Therefore, the above structure can improve performance of the fan shroud assembly by increasing the plenum area in comparison of the prior arts.

In more detail, as shown in FIGS. 7 and 8, a height H1 from the bottom B of the plenum 110 to connection point P2 and P4 between the first plenum portion 110*a* and the airflow guide portion 150 is higher than the height H2 from the bottom B of the plenum 110 to connection point P3 and P5 between the second plenum portion 110*b* and the airflow guide portion 150. So, the above satisfies the following Expression: H1>H2.

As shown in FIG. 7, a first bending portion 110*a*' is formed by bending an edge portion of the first plenum portion 110*a* toward the bottom B of the plenum 110 to a predetermined height h1, and a second bending portion 110*b*' is formed by bending an edge portion of the second plenum portion 110*b* to a height h2 lower than the height h1 of the first bending portion 110*a*'. So, the above satisfies the following Expression: h1>h2.

Meanwhile, as shown in FIG. 8, the first bending portion 110*a*' is formed by bending the edge portion of the first plenum portion 110*a* toward the bottom B of the plenum 110 to the predetermined height h1, and the second bending portion 110*b*' is formed by bending then edge portion of the second plenum portion 110*b* to the height h2 equal to the height h1 of the first bending portion 110*a*'. So, the above satisfies the following Expression: h1=h2.

That is, as shown in FIG. 8, when the height H1 from the bottom B of the plenum 110 to the connection point P4 between the first plenum portion 110*a* and the airflow guide portion 150 is higher than the height h1 of the first bending portion 110*a*' (H1>h1), the first plenum portion 110*a* excepting the first bending portion 110*a*' is downwardly inclined on the basis of the connection point P4.

On the contrary, as shown in FIG. 7, when the height H1 from the bottom B of the plenum 110 to the connection point P4 between the first plenum portion 110*a* and the airflow guide portion 150 is equal to the height hi of the first bending portion 110*a*' (H1=h1), the first plenum portion 110*a* excepting the first bending portion 110*a*' is formed evenly on the basis of the connection point P2.

Meanwhile, as shown in FIGS. 7 and 8, the height H2 from the bottom B of the plenum 110 to the connection point P3 and P5 between the second plenum portion 110*b* and the airflow guide portion 150 may be formed higher than the height h2 of the second bending portion 110*b*' to satisfy the following Expression: H2>h2.

As shown in FIG. 7, the height H2 from the bottom B of the plenum 110 to the connection point P3 and P5 between the second plenum portion 110*b* and the airflow guide portion 150 may be formed lower than the height h1 of the first bending portion 110*a*' to satisfy the following Expression: H2<h1.

As shown in FIG. 8, the height H2 from the bottom B of the plenum 110 to the connection point P3 and P5 between the second plenum portion 110*b* and the airflow guide portion 150 may be formed higher than the height h1 of the first bending portion 110*a*' to satisfy the following Expression: H2>h1.

As shown in FIGS. 7 and 8, the height Hi from the bottom B of the plenum 110 to the connection point P2 and P4 between the first plenum portion 110*a* and the airflow guide portion 150 may be formed higher than the height h2 of the second bending portion 110*b*' to satisfy the following Expression: H1>h2.

As a result of tests of the fan shroud assembly of the present invention and the prior arts, which are attached to a heat exchanger, in connection with airflow, power consumption and noise, the fan shroud assembly according to the present invention saved power consumption of about 10% in conditions of the same airflow and noise, compared with the prior arts.

Therefore, a fan shroud assembly of the present invention can change the height of the plenum portion, which is a wider portion, when the fan is located not at the center of the plenum but at the eccentric position to secure a larger plenum area so as to increase airflow, and improve its performance, i.e., reduction of power consumption and noise.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A fan shroud assembly comprising: a rectangular-shaped plenum having a first plenum portion of a larger side and a second plenum portion of a smaller side, the first and second plenum portions and being mounted eccentrically to each other; a fan shroud formed on an air discharge side of the plenum, the fan shroud having a airflow guide portion in which a fan having a blade and a band for connecting the outer end of the blade is positioned; and a motor for driving the fan, wherein a connection point between the first plenum portion and the airflow guide portion is located within a height of the band, and wherein a height (H1) from the bottom of the plenum to connection point and between the first plenum portion and the airflow guide portion is higher than a height (H2) from the bottom of the plenum to connection point and between the second plenum portion and the airflow guide portion to satisfy the following Expression:

H1>H2.

2. The fan shroud assembly according to claim 1, wherein a first bending portion is formed by bending an edge portion of the first plenum portion toward the bottom of the plenum to a predetermined height (h1), and a second bending portion is formed by bending an edge portion of the second plenum portion to a height (h2) lower than the height (h1) of the first bending portion to satisfy the following Expression:

h1>h2.

3. The fan shroud assembly according to claim 1, wherein the first bending portion is formed by bending the edge portion of the first plenum portion toward the bottom of the plenum to the predetermined height (h1), and the second bending portion is formed by bending the edge portion of the second plenum portion to the height (h2) equal to the height (h1) of the first bending portion to satisfy the following Expression:

h1=h2.

4. The fan shroud assembly according to claim 2, wherein when the height (H1) from the bottom of the plenum to connection point between the first plenum portion and the airflow guide portion is equal to the height (h1) of the first bending portion to satisfy the following Expression: H1=h1, the first plenum portion excepting the first bending portion is formed evenly on the basis of the connection point.

5. The fan shroud assembly according to claim 3, wherein when the height (H1) from the bottom of the plenum to the connection point between the first plenum portion and the airflow guide portion is higher than the height (h1) of the first bending portion to satisfy the following Expression: H1>h1, the first plenum portion excepting the first bending portion is inclined downwardly on the basis of the connection point.

* * * * *